US005851711A

United States Patent [19]

Kawabata et al.

[11] Patent Number: 5,851,711

[45] Date of Patent: Dec. 22, 1998

[54] IMAGE FORMING METHOD

[75] Inventors: Katuichi Kawabata; Kouichi Itou; Hiroaki Miho, all of Hino, Japan

[73] Assignee: Konica Corporation, Tokyo, Japan

[21] Appl. No.: 777,209

[22] Filed: Dec. 27, 1996

[30] Foreign Application Priority Data

Jan. 9, 1996 [JP] Japan ..... 8-001530

[51] Int. Cl.[6] ..... G03G 13/09

[52] U.S. Cl. ..... 430/45; 430/122

[58] Field of Search ..... 430/106.6, 108, 430/122, 45

[56] References Cited

U.S. PATENT DOCUMENTS

| | | | |
|---|---|---|---|
| 4,599,285 | 7/1986 | Haneda et al. | 430/54 |
| 5,217,835 | 6/1993 | Watanabe et al. | 430/122 |
| 5,494,770 | 2/1996 | Baba et al. | 430/122 |

*Primary Examiner*—John Goodrow
*Attorney, Agent, or Firm*—Frishauf, Holtz, Goodman, Langer & Chick, P.C.

[57] ABSTRACT

In a non-contact development with a two component type developer composed of toner particles and resin-coated tic carrier particles, the resin-coated magnetic carrier particles have a specific electric resistance of $10^5$ Ω·cm to $10^{12}$ Ω·cm, and a strength of magnetic field on a surface of a cylindrical developing sleeve at the closest position between cylindrical developing sleeve and a photoreceptor drum in a developing region is 1000 G(gauss) to 2500 G.

6 Claims, 4 Drawing Sheets

IMAGE FORMING METHOD

BACKGROUND OF THE INVENTION

The present invention relates to an electrophotographic image forming method, used for copying machines and printers, specifically for forming color images and an apparatus using the same.

Heretofore, among image forming systems used for copying machines and printers, almost all systems requiring high image quality have employed an electrophotographic system.

Recently, in the electrophotography field too, demand for color outputting is strong. Accordingly, study of electrophotographic color image forming methods and apparatus using such method have proliferated. Among them, a KNC type color image forming method wherein a series of processes in which latent images formed due to uniform charging and image exposure on an image forming body (mainly, a photoreceptor) are subjected to reversal development and are simultaneously transferred on a recording sheet are repeated for forming a superposed color image on aforesaid image forming body and then images are simultaneously transferred on a recording sheet has been taken notice, and many technologies related to this method have been studied since it has a compact mechanism and it can provide a high-quality image.

With regard to the KNC method, there are many inventions such as the one disclosed in Japanese Patent Publication Open to Public Inspection (hereinafter, referred to as Japanese Patent O.P.I. Publication) No. 76766/1985. Japanese Patent O.P.I. Publication No. 95456/1985 discloses an image forming method which prepares a color-superposed image by repeating a process two or more times which non-contact-develops a latent image formed on a developer conveyance image carrier (development sleeve) by a vibrating electrical field formed between aforesaid carrier and an image forming body, wherein a better image quality is obtained by preparing an electrostatic latent image is formed using dot exposure by means of a laser beam and by superposing each dot of yellow, magenta and cyan color image.

Japanese Patent O.P.I. Publication No. 118775/1986 discloses that, in order to increase accuracy on superposing of latent images repeatedly prepared on an image forming body by means of the above-mentioned system, a photoreceptor drum made of a rigid body such as metal and a drum index is mounted on the drum shaft thereof and that latent images having each color in which superposing accuracy is extremely excellent by starting exposure every time based on signals occurred from aforesaid drum index.

In addition, studies of the electrostatic development method, as a central technology of the image forming method, are extensively conducted. Among these, technologies whose theme are particle size of a developer and technologies regarding to non-contact development have been filed in many instances.

For example, Japanese Patent O.P.I. Publication No. 129437/1983 doubly controls the average particle size of the toner in a two-component developer from viewpoint of the content of the weight distribution and particle number distribution in order to avoid practical interference and also controls the weight distribution of the weight. In addition, Japanese Patent O.P.I. Publication No. 147652/1982 discloses, as a toner's friction charging system, to introduce a two-component developer at a gap constituted between two plate facing each other, to cause aforesaid developer to be charged due to the alternating electrical field provided to between two plates and to non-contact-develop using aforesaid toner. Japanese Patent O.P.I. Publication No. 140361/1985 discloses a development method which develops a two-component developer under a vibration electrical field, wherein the amount of particles whose average particle size is ¼ or less of the average particle size is 2 wt % or less of the toner amount.

However, even in the above-mentioned conventional examples, a new technology which practically bear actual use has not sufficiently been developed. Specifically, in the case of the KNC method, in order to form a thin developer layer having 200–300 μm thickness on the development sleeve, a conveyance control bar is caused to be pressed on the surface of the sleeve for controlling the layer thickness and, after development, aforesaid developer layer is removed from the surface of the sleeve. In such an occasion, developers may be fixed each other, or a developer is fused on the sleeve. It is a current status that aforesaid phenomenon interferes further improvement in image quality and in durability for the electrophotographic image forming method and an apparatus using the same.

SUMMARY OF THE INVENTION

An object of the present invention is to enhance image quality of a color image forming method and an apparatus using the same each employing the KNC method and improve durability of a developer and a developing device.

An object of the present invention is attained by the following constitutions.

[1] An image forming method which forms a superposing color image on aforesaid image forming body by repeating a series of processes which reversely develops latent images formed due to uniform and image exposure on an image forming body, wherein aforesaid reversal development is conducted by a two-component non-contacting development method employing a carrier and a toner and the resin coating magnetic carrier in which the specific resistance of the carrier is $10^5\Omega\cdot$cm or more and $10^{12}\Omega\cdot$cm or less is used.

[2] The image forming method described in item [1] above, wherein the surface magnetic field on the development sleeve at the closest point between the image forming body and the development sleeve in the development region of the developing device used for the above-mentioned reversal development is 1000 G or more and 2500 G or less.

[3] The image forming method described in item [1] above, wherein the average particle size by volume of the above-mentioned magnetic carrier is 10 μm or more and 50 μm or less.

[4] The image forming method described in item [1] above, wherein the saturated magnification of the above-mentioned magnetic carrier is 10 emu/g or more and 50 emu/g or less.

[5] The image forming method described in item [1] above, wherein the specific resistance of the above-mentioned carrier is $10^7\Omega\cdot$cm pt more and $10^{10}\Omega\cdot$cm or less.

[6] An image forming apparatus which forms a superposing color image by repeating a series of processes which reversely develops latent images formed due to uniform and image exposure on an image forming body, wherein aforesaid reversal development is conducted by a two-component non-contacting development method employing a carrier and a toner and the coating magnetic carrier in which the specific resistance of the carrier is $10^5\Omega\cdot$cm or more and $10^{12}\Omega\cdot$cm or less is used.

[7] An image forming method which forms a superposing color image by repeating a series of processes which reversely develops latent images formed due to uniform and image exposure on an image forming body, wherein aforesaid reversal development is conducted by a two-component non-contacting development method employing a carrier and a toner and the coating magnetic carrier in which the magnetic permeability of the carrier has the following relationship is used:

$\sigma_s/\sigma_{500} \leqq 2.0$ $\sigma_s$: Saturated magnification $\sigma_{500}$: magnification in the magnetic field of 500 Oe

[8] The image forming method described in item [7] above, wherein the surface magnetic field on the development sleeve at the closest point in the development region of the developing device used for the above-mentioned reversal development is 1000 G or more and 2500 G or less.

[9] The image forming method described in item [7] above, wherein the average particle size by volume of the above-mentioned magnetic carrier is 10 $\mu$m or more and 50 $\mu$m or less.

[10] The image forming method described in item [7] above, wherein the saturated magnification of the above-mentioned magnetic carrier is 10 emu/g or more and 50 emu/g or less.

[11] The image forming method described in item [7] above, wherein the specific resistance of the above-mentioned magnetic carrier is $10^7\Omega\cdot$cm or more and $10^{10}\Omega\cdot$cm or less.

[12] An image forming apparatus which forms a superposing color image by repeating a series of processes which reversely develops latent images formed due to uniform and image exposure on an image forming body, wherein aforesaid reversal development is conducted by a two-component non-contacting development method employing a carrier and a toner and the coating magnetic carrier in which the magnetic permeability of the carrier has the following relationship is used:

$\sigma_s/\sigma_{500} \leqq 2.0$ $\sigma_s$: Saturated magnification $\sigma_{500}$: magnification in the magnetic field of 500 Oe In the above-mentioned method and a constitution of the present invention, developerbility is improved because the strength of the electrical field on the surface of the developing layer is substantially increased and spattering distance of toner is reduced since the potential of the development sleeve and potential on the surface of the developing layer is in caused to be closer due to reducing the resistance value of the carrier. In addition, charge (counter charge) remaining on the carrier after the toner spattered is easily neutralized due to reducing the resistance value of the carrier. In addition, since image force between the development sleeve and the carrier is reduced, favorable developerability can be maintained. In addition, when the developer is collected from the sleeve after being development with a magnet roller, collection ability is also improved.

Owing to the fact that collection ability is improved, it is not necessary to provide noticeable stress on the developer when collecting. Accordingly, durability of the developer is increased. After sufficient collection was made, developer used is possible to form a completely new developer layer on the development sleeve. Due to this, an image having favorable developability and having no ghost and thereby having reproducibility with high fidelity can be obtained.

Referring to FIG. 3, saturated magnification and magnification ratio in a 500 Oe magnetic field will be explained.

Curves in FIG. 3 show magnification curves showing magnification characteristics of carriers a, b and c. In a table in FIG. 3, magnification, saturated magnification and magnification ratio of each carrier at $\sigma_{500}$. Since the magnification curve of carrier a abruptly rises even in an area where the strength of the magnetic field is weak, it can be understood that carrier a is easily magnified. In addition, under a weak magnetic field, since aforesaid carrier a is magnified close to the saturated magnification, ratio between the saturated magnification and magnification under a magnetic field of 500 Oe is so small as to be 1.43. On the contrary, the magnification curve of carrier c. rises gently. It can be understood that, as the magnetic field becomes intense, aforesaid carrier c. is gradually magnified. Accordingly, ratio between the saturated magnification and magnification under a magnetic field of 500 Oe is so large as to be 2.88. From above, it can be understood that a carrier having small ratio between the saturated magnification and magnification under a 500 Oe magnetic field has a characteristic that it is magnified close to the saturated magnification even under a weak magnetic field.

In the present invention, by the use of a carrier having a relationship of magnification ratio of ($\sigma_s/\sigma/_{500} \leqq 2.0$), namely by the use of a carrier having a characteristic that it is magnified close to the saturated magnification even under a weak magnetic field, developability can be improved and durability of the developer can be improved as well due to improving the collection properties of the developer from the sleeve after being development. Incidentally, magnification ratio of ($\sigma_s/\sigma/_{500} \leqq 2.0$) is preferably 1.5 or less. The better, the value is closer to 1.0.

As the composition of the core material of magnetic body of carrier having a small magnification, (Mn, Zn)O·$Fe_2O_3$, (Ni, Zn)O·$Fe_2O_3$ and (Mg, Zn)O·$Fe_2O_3$ are cited. In addition, there is no coating resin, and resins conventionally used for coating the carrier, such as a silicone resin, a styrene/acrylic resin, a fluorine resin and an olefin resin can be used.

The thickness of resin coating layer is preferably 0.1 to 10.0 $\mu$m, and more preferably 0.5 to 5.0 $\mu$m. If aforesaid layer thickness is too thin, the resistance value is reduced. If the layer thickness is excessive, it is difficult to keep the layer thickness uniformly, causing isolation of the resin-laminated layer, resulting in image fogging.

The particle size of the carrier is preferably 10 $\mu$m or more and 50 $\mu$m or less, and more preferably 20 $\mu$m or more and 30 $\mu$m or less.

The average particle size by volume of the carrier is measured typically with a laser diffraction type distribution measurer "HELOS" (produced by Sympatec Inc.) provided with a wet-type dispersing machine.

The saturated magnification of the carrier is preferably 10 emu/g or more, and preferably 50 emu/g or less. Specifically more preferable is 20 emu/g or more and 30 emu/g or less. If the saturated magnification of the carrier is less than 10 emu/g, a phenomenon that the carrier is adhered on undeveloped portion of the photoreceptor. If it exceeds 50 emu/g, soft and uniform developer layer is difficult to be formed on the development sleeve. In addition, the specific resistance of the coating carrier is preferably $10^5\Omega\cdot$cm or more, and more preferably $10^{12}\Omega\cdot$cm or less. If it is less than $10^5\Omega\cdot$cm, so-called bristling of the developer layer becomes extremely coarse. In addition, leakage of charge occurs, reducing image performance. If it exceeds $10^{12}\Omega\cdot$cm, bias potential is difficult to effect on the surface of the developer layer. Accordingly, the preferable range thereof is $10^7\Omega\cdot$cm or more and $10^{12}\Omega\cdot$cm or less. In order to control the resistance value of the carrier, either of changing the kind of the resin, changing coating layer thickness or adding conductive substance such as carbon to a resin.

In the present invention, the resistance value is that measured employing static resistance. Practically, the resistance value is calculated from the resistance of the carrier layer measured with load of 200 g/cm$^2$ under the electrical field of 1000 v/cm. Incidentally, the measurement conditions were 20° C. and 50% RH.

Resistance value (Ω·cm)=R×S/t wherein R represents resistance (Ω); S represents a cross area (cm$^2$) of the Sample carrier; and t represents the thickness of Sample carrier (cm).

Next, in the present invention, the strength of the magnetic field at the closest point in the development region on the surface of the development sleeve is 1000 G or more and preferably 1500 G or more. In order to arrange 1000 G or more, the dispersion in terms of the height (bristling) of the developer layer becomes smaller, resulting in favorable effects in terms of noise reduction. Incidentally, the conventional strength of magnetic field on the sleeve of the developing device was 700 G. Practically, it is not easy to increase the strength of the magnetic field to 2500 G or more. In addition, its effects also become saturated. Accordingly, it is not necessary to arrange to a value not less than 2500 G. The strength of the magnetic field can be measured by gauss meter.

The average particle size by volume of toner is ordinarily 5–20 μm, and 4–10 μm is specifically preferable in terms of obtaining high image quality. For measuring the average particle size by volume of toner, coal tar counter is ordinarily used. As the coal tar counter, for example, Coulter TA-II (produced by Coal Tar Inc.) is used. Before measurement, toner was dissolved in battery electrolyte ISOTONE-II (produced by Nikka Ki Co., Ltd.) and then dispersed. Measurement was conducted using the above-mentioned coal tar counter. In order to increase accuracy, measurement may be repeated for twice or three times.

As an additive other than colorants or parting agents, for example, charge controllers and cleaning improvers and fluidity improvers may be used.

The binder resin constituting the toner is not specifically limited. Resins conventionally used in this field may be used. Practically, for example, styrene-containing resins, a styrene/acrylic type resins, styrene/butadiene-containing resins, ester-containing resins and epoxy resins can be used. Of these, in order to constitute toner having high friction chargeability, ester-containing resins, specifically styrene/acrylic-containing resins may preferably be used. These resins may be used independently or admixture thereof may be used in combination.

There is also no limit to the kind of colorants. Numerous dyes and pigments such as carbon black, phthalocyanine blue, pigment Green B and Solvent Red 49 may be used. As a parting agent, for example, low molecular olefin, aliphatic group ester, aliphatic group ester-containing wax and carnaba wax may be used. As a charger controller, for example, nigrocine-containing dyes and metal complex-containing dye may be used.

As a cleaning improver, for example, aliphatic group metallic salts such as zinc stearate and lithium stearate and polymer fine particle may be used. As a fluidity improver, for example, an inorganic fine particle is used. Inorganic oxide fine particles such as silica, alumina and titania are preferably used. It is preferable that these inorganic oxide fine particles is subjected to hydrophobization processing by means of a silane coupling agent.

For manufacturing toner, binder resins, colorants and parting agents are mixed by means of a Henshell mixer. The resulting mixture is kneaded while dispersing colorants and parting agents were dispersed under various conditions. Following this, the resulting process passes a crushing process and a classifying process. If necessary, a cleaning improver and a fluidity improver can be mixed from outside.

DETAILED DESCRIPTION OF THE PREFERRED EMBODIMENT

Figure 1:
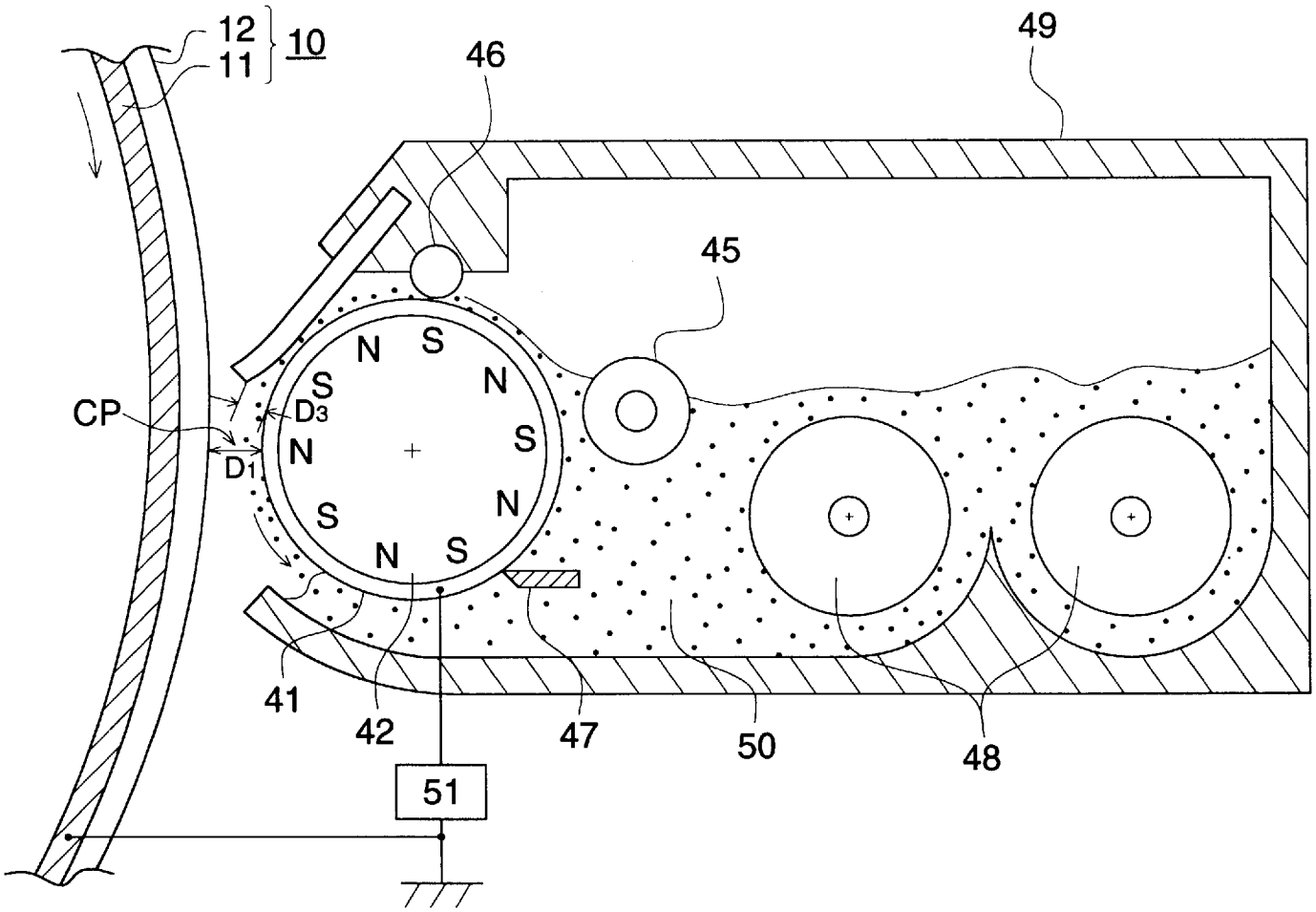
FIG. 1 is a block diagram showing an example of a developing device of the present invention.

FIG. 1 shows a cross sectional view of an example of a developing device used for an image forming method of the present invention. In FIG. 1, numeral 41 represents a development sleeve which is a developer conveyance body having magnet 42 fixed inside thereof. Numeral 46 is a control bar which is a developer conveyance amount regulation member. Numeral 47 is a scraper which is a member for scraping the developer. Numeral 48 represents a stirring roller which is a developer-stirring member. Numeral 49 represents casing of the developing device. Numeral 50 represents a two-component developer composed of toner T and carrier C. Numeral 51 represents a power supply as a bias imprinting means. Numeral 10 represents a photoreceptor which is an image forming body wherein photoreceptor layer 12 is formed on conductive substrate 11. $D_1$ represents the closest distance between the above-mentioned photoreceptor drum 10 and the above-mentioned development sleeve 41 at the closest point CP in the developing region. An arrow in numeral 10 in FIG. 1 shows the rotation direction of the above-mentioned photoreceptor drum 10 and the above-mentioned development sleeve 41.

Development sleeve 41 is a cylinder, whose diameter is 0.5–3 cm, composed of a non-magnetic and conductive metal such as aluminum and stainless steel. It is so fabricated that the surface coarseness (Rz) is 1–30 μm. Inside the above-mentioned development sleeve 41, magnet 42 which is an aggregate of cylinder-type or chop-stick type (a pillar type) having 4-12 poles magnetized to N-pole or S-pole are fixed so that the strength of the magnetic field on the surface of aforesaid development sleeve 41 at the closest point CP is 1,000 G to 2,500 G. Aforesaid development sleeve 41 is rotatable against the above-mentioned magnet 42.

Casing 49 is made of an insulating resin such as an acrylic resin and polycarbonate. Inside aforesaid casing 49, development sleeve 41 housing the above-mentioned fixed magnet 42, supplying roller 45, scraper 47 and stirring roller 48 are located. At the outlet of the above-mentioned casing 49, control bar 46 is located.

Inside the above-mentioned casing 49, two-component developer 50 composed of toner T and carrier C is stored. Concurrently with being stirred by the above-mentioned agitating screw 48 to be mixed, aforesaid two-component developer 50 is adhered on the above-mentioned development sleeve 41 after being supplied by the above-mentioned supplying roller 45 for forming a magnetic brush. Aforesaid magnetic brush is conveyed while its conveyance amount is controlled by the above-mentioned controlling bar 46 together with the rotation of the above-mentioned development sleeve 41.

In the above-mentioned development sleeve 41, A.C. voltage having D.C. component from the above-mentioned power supply 51 is imprinted. At a gap between development sleeve 41 and the above-mentioned photoreceptor drum 10, strong oscillation electrical field is formed. Due to the above-mentioned strong oscillation electrical field, toner T is separated from carrier C and flies, creating toner cloud. Due to this, flying of the toner to the latent images on the above-mentioned photoreceptor drum 10 so that the toner image is formed on the above-mentioned photoreceptor drum 10.

Figure 2:
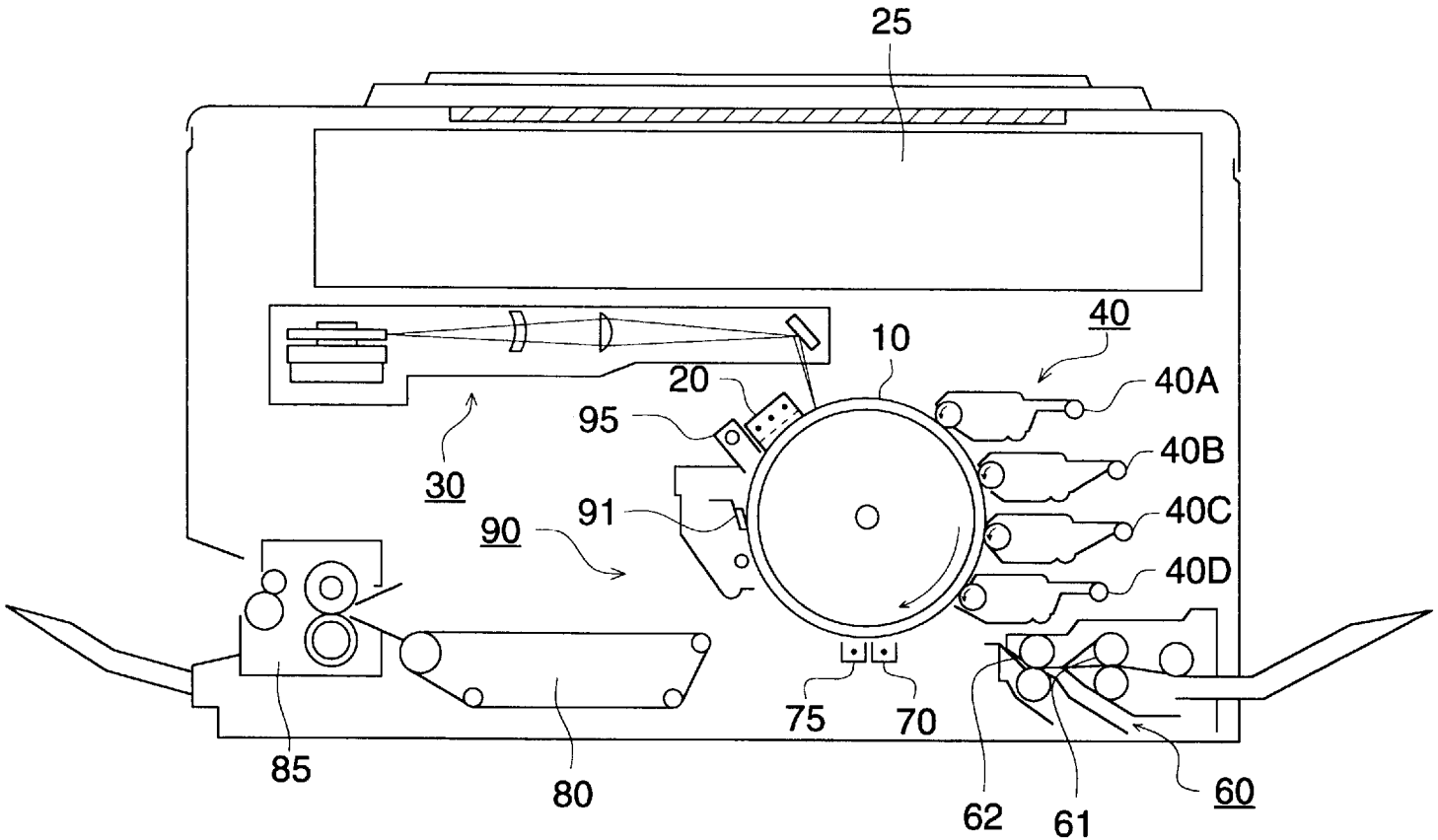
FIG. 2 is a block diagram showing an example of an image forming device of the present invention.
Figure 3:
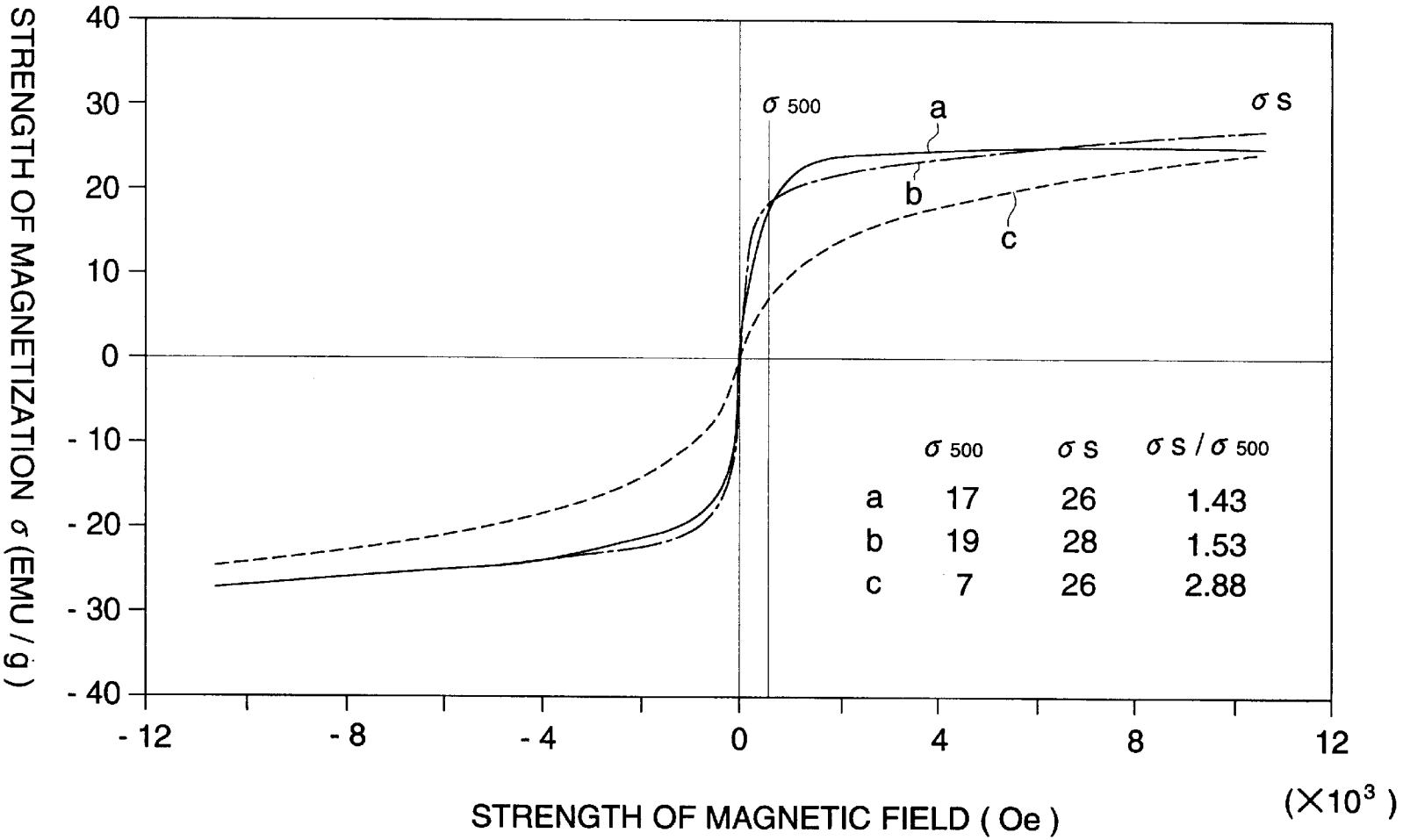
FIG. 3 is a performance drawing showing a magnetic characteristic of each carrier.

FIG. 2 is a block diagram showing an example of an image forming apparatus of the present invention. In FIG. 2, numeral 10 represents a photoreceptor drum, which is an image forming body. Numeral 20 represents a scorotron charger, which is a charging means. Numeral 25 represents an image reading unit. Numeral 30 represents an image writing unit, using a laser beam, which is an exposure means. Numeral 40A, 40B, 40C and 40D are developing devices as shown in FIG. 1 housing different colors two-component developer. Numeral 60 is a paper feeding section provided with the first paper feeding roller 61 and the second paper feeding roller 62. Numeral 70 represents a corona charger for transferring operation, which is a transferring means. Numeral 75 represents a corona charger for separation, which is a separation means. Numeral 80 represents a conveyance unit. Numeral 85 represents a fixing unit. Numeral 90 represents a cleaning device provided with a cleaning blade 91. Numeral 95 represents a pre-charging exposure lamp. An arrow in FIG. 2 shows a rotation direction of the above-mentioned photoreceptor drum 10.

The basic operations of multi-color image forming process of the present invention will now be explained as below. Namely, first, a copying starting command is sent to the control unit (not illustrate) from the operation unit (not illustrated) so that photoreceptor drum 10 starts its rotation. Following rotation of the above-mentioned photoreceptor drum 10, the circumference thereof is uniformly charged by means of scorotron charger 20. In image reading unit 25, optical information from the original is converted to an electrical signal. After aforesaid electrical signal is subjected to image processing, it is inputted into image writing unit 30. On the above-mentioned charged photoreceptor drum 10, a laser beam is irradiated from image writing unit 30 so that latent images are formed on the above-mentioned photoreceptor drum 10. The latent images on the above-mentioned photoreceptor drum 10 are developed either of the above-mentioned developing devices 40A, 40B, 40C or 40D so that toner images are formed on the above-mentioned photoreceptor drum 10.

Photoreceptor drum 10 wherein the above-mentioned toner is formed is uniformly charged again by means of the above-mentioned scorotron charger. On the above-mentioned image writing unit, a laser beam is irradiated so that the next latent images are formed. The latent images on the above-mentioned photoreceptor drum 10 is developed by either of the above-mentioned developing devices 40A, 40B, 40C and 40D so that next toner images are superposed on the above-mentioned photoreceptor drum 10.

In the present Example, the above-mentioned latent images forming process and the developing process are repeated for four times so that toner images having four colors are superposed on the above-mentioned photoreceptor drum 10.

In paper feeding unit 60, recording sheets which are transferred medium are housed. Each recording sheet is fed out to corona charger 70 for transferring by means of the first paper feeding roller 61 and the second paper feeding roller 62 in synchronous with toner image superposed on the above-mentioned photoreceptor drum 10. The toner images superposed on the above-mentioned photoreceptor 10 is transferred onto a recording sheet by means of the above-mentioned corona charger 70 for transferring. Aforesaid recording sheet is separated from the above-mentioned photoreceptor drum 10 by means of corona charger 75 for separation. The recording sheet wherein the toner images have been transferred is conveyed to fixing unit 85 through conveyance unit 80. At the fixing unit, after being fused, pressed and fixed, the recording sheet is emitted to outside the apparatus.

On the other hand, toner, not transferred on a recording sheet, which remained on the above-mentioned photoreceptor drum 10, scraped by a cleaning device provided with a cleaning blade 91 which is brought into contact with the above-mentioned photoreceptor drum 10 from aforesaid toner, residual potential is removed by means of pre-charging exposure lamp 95, and then enters into the next image forming process.

In the development in the present invention, non-contact development wherein A.C. voltage is imprinted is conducted. In this occasion, the frequency is preferably 50–50,000 Hz. The development electrical field in the development region is preferably 0.5 MV/m or more and 20 MV/m or less. Incidentally, the development electrical field means the following value.

Development electrical field $=\{V_{DC+VAC}/2-V_H\}/\mathrm{Dsd}$ wherein $V_{DC}$: D.C. voltage (V)

$V_{AC}$: A.C. Voltage at peak to peak (V)

$V_H$: Charging voltage of the photoreceptor (V)

Dsd: The closest distance between the photoreceptor and the development sleeve (m)

EXAMPLES

Hereinafter, the present invention will be explained in detail referring to Examples. However, the embodiment of the present invention is not limited thereto. Incidentally, "part" in the following sentences represents "part(s) by weight".

EXAMPLE 1

1) Preparation of carrier

On ferrite particles whose average particle size by volume was 28 μm, a 1 μm-thickness resin was coated in the following manner so that Carrier 1-1 for Example of the present invention was obtained.

In a laminating resin solution wherein 1 part of silicon resin was dissolved in 50 parts of xylene, 100 parts of the above-mentioned ferrite particles were dipped. Following this, the resulting mixture was heated so that xylene was removed. Further, the resulting mixture was subjected to heating for 3 hours at 180° C. Next, the coagulant was sieved.

Carriers for Example 1-1 through 1-12 and carriers for Comparative Example 1-1 and 1-2 were, except that, in ferrite particles having different particle size, the layer thickness and the amount of carbon added in the resin were changed as shown in Table 1 and the above-mentioned resin coating was conducted.

2) Preparation of toner

A hundred parts of polyester resin, 5 parts of carbon black and 3 parts of low molecular weight polypropylene were melted, kneaded, crushed and classified so that colored particles whose average particle size by volume were obtained. Next, 0.8 wt % of hydrophobic silica was added thereto so that a toner was obtained.

3) Preparation of a developer

Toner was added to carrier so that a developer having toner density of 6 wt % was prepared.

4) Image forming conditions

A non-contact two-component development type color copying machine Konica 9028 produced by Konica Corporation was improved, and with which images were formed under the following conditions.

Charging potential on the surface of the photoreceptor: 850 ; V using a titanylphthalocyanine lamination type organic photoreceptor DC bias: −750 V AC bias: 2.2 $kV_{p-p}$, 8 kHz Development region gap: 500 $\mu$m Layer thickness of the developer: A 3 mm diameter magnetic stainless steel control bar (SUS416) was pressed against the development sleeve (a developer conveyance body) so that a 250 $\mu$m layer thickness was obtained.

5) Evaluation method

Developability

By considering the overall development maximum density and the development minimum density, the developability was evaluated. A test chart of 4 superposed color images (yellow, magenta, cyan and black) superposed images was continuously copied for 50,000 sheets. The initiated few copied images and the final few images were visually observed and evaluated.

A: No problem

B: Practically no problem

C: Though there are some practical problems, they are not very serious.

D: There are apparent practical problems.

Noise

The evaluation method and the evaluation standards were the same as in the developability. An original wherein 2–10 lines/mm were drawn with each color was continuously copied for 50,000 sheets. The sharpness and resolution of the resulting initial and final few copies paper were visually observed and evaluated.

Durability

After the original was continuously copied for 50,000 sheets, the developer and the development sleeve were magnified 10 to 100 times so that the condition of fusion and fixing of the developer and the development sleeve were observed.

Ghost

An original having a stripe whose density was 1.3 in the recording sheet conveyance direction in the copying machine and also having a stripe whose density was 1.0 perpendicular to the direction of aforesaid stripe was copied, and how influence of the stripe in the conveyance direction appears on the copied image density of the stripe perpendicular thereto was observed. The lower the influence is, the better.

Reproducibility

An image wherein 2–10 lines/mm of line was drawn was outputted, and visually observed.

Actual copying tests were conducted in which the particle size of the carrier, saturated magnification, specific resistance and magnification on the development sleeve were changed. Table 1 shows the results thereof.

TABLE 1

| Example/ Comparative Example | Specific resistance of carrier (Ω · cm) | Particle size of carrier ($\mu$m) | Saturated magnification of carrier (emu/g) | Surface magnetic field of the sleeve (G) | Developability | Noise | Durability | Ghost | Reproducibility |
|---|---|---|---|---|---|---|---|---|---|
| Example 1-1 | $10^8$ | 30 | 30 | 2000 | A | A | A | A | A |
| Example 1-2 | $10^7$ | 30 | 30 | 2000 | A | A | A | A | A |
| Example 1-3 | $10^{11}$ | 30 | 30 | 2000 | B | A | B | B | B |
| Example 1-4 | $10^8$ | 30 | 30 | 1100 | A | B | A | A | A |
| Example 1-5 | $10^8$ | 15 | 30 | 2000 | A | A | A | A | A |
| Example 1-6 | $10^8$ | 40 | 30 | 2000 | A | B | A | A | A |
| Example 1-7 | $10^8$ | 8 | 30 | 2000 | A | C | A | A | A |
| Example 1-8 | $10^8$ | 60 | 30 | 2000 | A | C | A | A | A |
| Example 1-9 | $10^8$ | 30 | 17 | 2000 | A | A | C | C | A |
| Example 1-10 | $10^8$ | 30 | 38 | 2000 | A | B | A | A | A |
| Example 1-11 | $10^8$ | 30 | 45 | 2000 | A | C | A | A | A |
| Example 1-12 | $10^8$ | 30 | 8 | 2000 | A | A | C | C | A |
| Comparative Example 1-1 | $10^{14}$ | 30 | 30 | 2000 | D | B | D | D | D |
| Comparative Example 1-2 | $10^4$ | 60 | 45 | 800 | C | D | B | A | C |

Those of the present invention is at a practical level. Specifically, it can be understood that those employing high magnetic sleeve small particle size, low magnetized and low resistance carrier provide excellent properties.

EXAMPLE 2

1) Preparation of carrier

In the same manner as in Example 1-1, carrier for Example 2-1 through 2-13 and carrier for comparative example 2-1 and 2-2 were prepared. Modified points are as shown in Table 2.

2) Preparation of toner and developer

They were prepared in the same manner as in Example 1.

3) Image forming conditions

Images were formed in the same manner as in Example 1.

4) Evaluation method

Samples were evaluated in the same manner as in Example 1. Table 2 shows the results thereof.

TABLE 2

| Example/ Comparative Example | Ferrite used for the core material of carrier | Carrier @ 500 (emu/g) | Saturated magnification of carrier (emu/g) | Surface magnetic field of the sleeve (G) | Particle size of carrier (μm) | Durability | Noise | Ghost |
|---|---|---|---|---|---|---|---|---|
| Example 2-1 | Mn.Zn-containing | 23 | 30 | 2000 | 30 | A | A | A |
| Example 2-2 | Ni.Zn-containing | 22 | 30 | 2000 | 30 | A | A | A |
| Example 2-3 | Mg/Zn-containing | 25 | 30 | 2000 | 30 | A | A | A |
| Example 2-4 | Mg.Zn-containing | 23 | 30 | 1100 | 30 | A | B | A |
| Example 2-5 | Mg.Zn-containing | 23 | 30 | 2000 | 15 | A | A | A |
| Example 2-6 | Mg.Zn-containing | 23 | 30 | 2000 | 40 | A | B | A |
| Example 2-7 | Mg.Zn-containing | 13 | 17 | 2000 | 30 | C | A | C |
| Example 2-8 | Mg.Zn-containing | 29 | 38 | 2000 | 30 | A | B | A |
| Example 2-9 | Mg.Zn-containing | 17 | 30 | 2000 | 30 | B | A | B |
| Example 2-10 | Mg.Zn-containing | 23 | 30 | 2000 | 60 | A | C | A |
| Example 2-11 | Mg.Zn-containing | 32 | 45 | 2000 | 30 | A | C | A |
| Example 2-12 | Mg.Zn-containing | 6 | 8 | 2000 | 30 | C | A | C |
| Example 2-13 | Mg.Zn-containing | 23 | 30 | 2000 | 8 | C | A | C |
| Comparative Example 2-1 | Cu.Zn-containing | 11 | 30 | 2000 | 30 | D | A | D |
| Comparative Example 2-2 | Cu.Zn-containing | 11 | 60 | 800 | 60 | D | D | D |

All samples of the present invention are at practical levels, and it can be understood that all samples consist of a high magnification sleeve and employ carriers having small particle size, low magnification and low resistance provide excellent characteristics.

Figure 4:
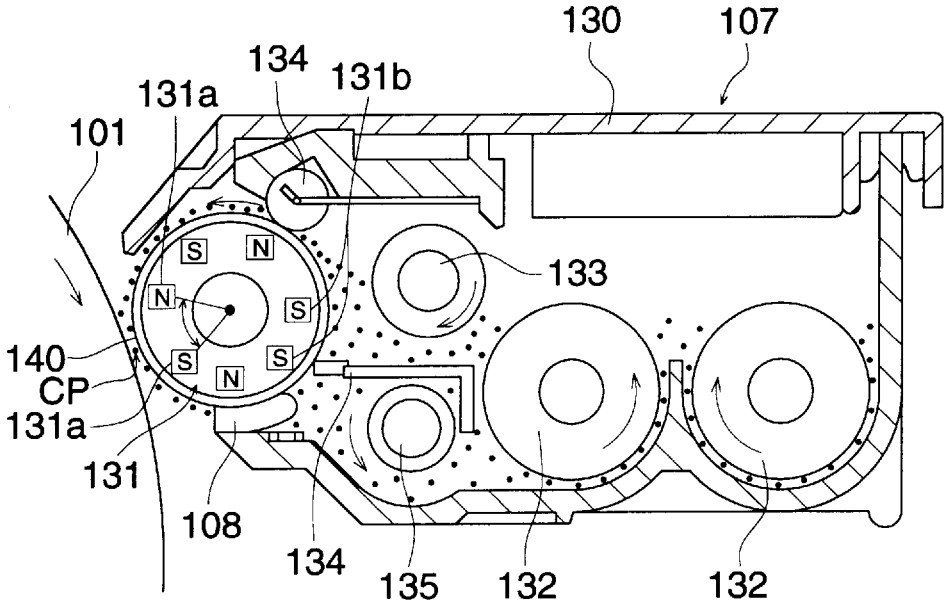
FIG. 4 is a block diagram showing another example of a developing device of the present invention.

FIG. 4 shows another example of a developing device of the present invention. In FIG. 4, in casing 103 in developing device 107, paired stirring screws 132 which contradictorily rotate each other are provided. Toner is replenished to above stirring screws 132 from a toner container. By means of stirring screws 132, the toner is stirred and mixed with a magnetic carrier to be charged. As a result, a two-component developer is made. The stirred two-component developer is conveyed to development sleeve 108 through feeding roller 133. The two-component developer is adhered on development sleeve 108 due to magnetic force for forming a developing layer. The developing layer is conveyed to control member 134 together with the rotation of development sleeve 108, where is controlled to a prescribed layer thickness. By the use of the two-component developer whose layer thickness had been controlled, vibrational electrical field is impressed to development region 140 in the vicinity where image carrier 101 and development sleeve 108 are in the closest contact portion CP so that non-contact development is conducted. Due to aforesaid non-contact development, toner moves to image carrier in accordance with electrostatic latent image on image carrier 101. The two-component developer wherein a part of toner has been consumed reaches scraper 134 following rotation of development sleeve 108, where aforesaid two-component developer is peeled off from development sleeve 108 by means of scraper 134. At a position corresponding to aforesaid scraper 134, paired magnets 131*b* having the same polarity each other is provided so that repulsive magnetic field occurs, promoting aforesaid peeling off by means of scraper 134. Under aforesaid repulsive magnetic field, the developer peeled off from development sleeve 108 is collected by collection roller 135, and then is conveyed to paired stirring screw section 132. To the developer collected as above, toner is replenished in stirring screw section 132 so that a new two-component developer is reproduced newly and continuously used.

In the above-mentioned constitution and in the above-mentioned example, the strength of magnet 131*a* in the vicinity of development region 140 is relatively so high as 1500 G. Therefore, carrier of the present invention having relatively low resistance can be maintained on development sleeve 108. Even under vibrational electrical field, movement the carrier to image carrier 101 is prevented. On the other hand, the strength of the magnetic field by magnet 131*b* located at inlet portion of scraper 134 is relatively so low as to be 500 G, causing carrier easily peeled off from development sleeve 108. In this occasion, repulsive magnetic field due to paired magnet 131*b* having the same polarity each other becomes weak. However, carrier of the present invention wherein ratio of saturated magnification and magnification in the 500 Oe magnetic field is small has a characteristic that it is magnified close to the saturated magnification even under a weak magnetic field. Therefore, aforesaid carrier having a small magnification ratio under the repulsive magnetic field is peeled off due to large repulsive force. In addition, the carrier peeled off is adhered even when the magnetic force of the collection roller is weak. Aforesaid carrier is collected and conveyed.

Accordingly, after developing, collection of the developer remaining on development sleeve 108 becomes facilitated. As a result, replacement between the developer wherein a part of toner has been consumed and the development wherein the toner is replenished and reproduced on development sleeve 108 becomes sure so that developability is improved. In addition, since developer used can be collected from development sleeve 108 easily without adding excessive shearing force. Therefore, durability of the developer is improved.

Owing to the present invention, the KNC type color image forming method wherein a series of processes in which latent images formed due to uniform charging and image exposure on an image forming body are subjected to reversal development and are simultaneously transferred on a recording sheet are repeated for forming a superposed color image and an apparatus using the same can further realize enhancement of high image and improvement of durability.

What is claimed is:

1. A method of forming a multi-color image on a photoreceptor with plural developing devices each different in color from others, wherein each developing device comprises a developing sleeve which is cylindrical and rotatable and a stationary magnetic member which is fixed inside the developing sleeve and has plural magnetic poles, and wherein each developing device faces the photoreceptor so as to form a developing region between the photoreceptor and the developing sleeve and a distance between the developing sleeve and the photoreceptor becomes shortest at the closest position between the developing sleeve and the photoreceptor on the developing region, comprising:

conducting an image forming step which comprises charging the photoreceptor; imagewise exposing the photoreceptor so that an electrostatic latent image is formed; and developing the electrostatic latent image with color toner particles by using one of the plural developing devices so that a color toner image is formed on the photoreceptor; and repeating the image forming step for each color by selectively using another one of the plural developing devices in accordance with a color to be formed so that different color toner images are superimposed one after another on the photoreceptor;

the developing step of each image forming step comprising agitating the color toner particles and resin-coated magnetic carrier particles so as to form a color developer in which the color toner particles are triboelectrically charged and adhered on the resin-coated magnetic carrier particles, wherein the resin-coated magnetic carrier particles have a specific electric resistance of $10^5$ Ω·cm to $10^{12}$ Ω·cm;

attracting the developer onto the developing sleeve by an attracting magnetic field formed between neighboring different poles of the plural magnetic poles so that a developer layer is formed on the developing sleeve;

regulating a thickness of the developer layer smaller than 300 μm on the developing sleeve so that the thickness of the developer layer becomes smaller than the shortest distance between the developing sleeve and the photoreceptor and the developing layer is not brought in contact with the photoreceptor;

rotating the developing sleeve so as to convey the developer layer to the developing region in which a strength of attracting magnetic field formed at the closest position on a surface of the developing sleeve by the magnetic member is 1000 gauss to 2500 gauss;

applying an oscillating electric bias in the developing region so that the toner particles shift from the developer layer to the latent image on the photoreceptor; and removing the used developer from the developing sleeve by a removing member.

2. The method of claim 1, wherein the thickness of the developer layer is larger than 200 μm.

3. The method of claim 1, wherein an average particle size of the resin-coated magnetic carrier particles is 10 μm to 50 μm.

4. The method of claim 1, wherein a saturated magnetization of the resin-coated magnetic carrier particles is 10 emu/g to 50 emu/g.

5. The method of claim 1, wherein a specific electric resistance of the resin-coated magnetic carrier particles is $10^7$ Ω·cm to $10^{10}$ Ω·cm.

6. The method of claim 1, wherein the resin-coated magnetic carrier particles satisfy a relation represented by a formula ($\delta_s/\delta_{500} \leqq 2.0$), wherein $\delta_s$ represents a saturated magnetization and $\delta_{500}$ represents magnetization under 500 oersted of magnetic field.

* * * * *